United States Patent [19]

Bauer

[11] 4,455,100

[45] Jun. 19, 1984

[54] POCKET-SIZED CHECK WRITING DEVICE WITH CHECK FORM

[76] Inventor: Sebastian Bauer, Kufsteiner Strasse 5, D-8201 Raubling/Obb., Fed. Rep. of Germany

[21] Appl. No.: 356,819

[22] Filed: Mar. 10, 1982

Related U.S. Application Data

[63] Continuation-in-part of Ser. No. 101,170, Dec. 7, 1979, abandoned.

[30] Foreign Application Priority Data

Dec. 7, 1978 [DE] Fed. Rep. of Germany ..... 2852989

[51] Int. Cl.[3] ..... B41J 3/21; B41J 3/36; B41J 3/46

[52] U.S. Cl. ..... 400/88; 400/84; 400/118; 400/95; 101/93.04; 354/5; 355/27

[58] Field of Search ..... 400/88, 95–99, 400/103–105, 636, 119, 118; 101/18, 93.04; 355/1, 27, 39, 40, 7, 112; 354/5; 177/5; 346/104, 143

[56] References Cited

U.S. PATENT DOCUMENTS

| | | | |
|---|---|---|---|
| 3,454,956 | 7/1969 | Icenbice, Jr. et al. | 346/104 |
| 3,899,775 | 8/1975 | Larsen | 177/5 |
| 3,922,965 | 12/1975 | Platt | 101/93.16 |
| 3,940,758 | 2/1976 | Margolin | 400/88 |
| 3,971,465 | 7/1976 | Benn | 400/119 |
| 3,987,467 | 10/1976 | Cowles | 355/40 |
| 3,999,050 | 12/1976 | Pitroda | 400/88 |
| 4,096,486 | 6/1978 | Pfeifer et al. | 354/5 |
| 4,175,841 | 11/1979 | LaPorte | 400/636 |
| 4,290,688 | 9/1981 | Call | 355/1 |
| 4,297,022 | 10/1981 | Lester | 355/1 |

*Primary Examiner*—William Pieprz

*Attorney, Agent, or Firm*—Oblon, Fisher, Spivak, McClelland & Maier

[57] ABSTRACT

A pocket-size check writing device is disclosed with a means for positioning a check form in a writing position having a number of predetermined writing types composed of individual symbol elements and with a manually operable device for actuating the writing type and reproducing the symbols of the writing type such that each writing type is constructed as a mosaic writing head with the symbol elements being independent of one another and individually controllable and being disposed in relating to one another such that they can be assembled in groups for the predetermined writing symbols in such a format that at each writing location one mosaic writing head is immovably disposed and has an arrangement whereby a keyboard reproduces the writing symbols and a control unit is provided which associates individual mosaic writing heads with an appropriate set of keys.

12 Claims, 8 Drawing Figures

POCKET-SIZED CHECK WRITING DEVICE WITH CHECK FORM

This application is a continuation of Ser. No. 101,170 filed Dec. 7, 1979, now abandoned.

BACKGROUND OF THE INVENTION

1. Field of the Invention

The invention relates to a pocket-sized check writing device with a means of positioning a check form in a writing position, with a number of predetermined writing type composed of individual symbol elements and a manually operable device for actuating the writing type and reproducing the symbols of the writing type.

2. Description of the Prior Art

Such a device is known from U.S. Pat. No. 2,826,987. In the case of the known check writing device, the means of positioning a check form is constructed as a chamber adapted to the overall dimensions of a check form, the writing type being built up from punch-like symbol elements. The writing type provided in this case are the digits 0 to 9 which are disposed one after another on an endless belt. The belt is passed around the chamber and transversely across the check. By displacement of the belt in its longitudinal direction, it is possible for whichever writing type is required to be brought into the writing position over the place on which the check is to be inscribed. By exerting a mechanical pressure on the writing type, the desired symbols are printed on the check form. This device has the disadvantage that per area of inscription, it is necessary to provide an many writing symbols as might possibly be required for the area of inscription. If the writing symbols are restricted to numbers and if there are only five writing areas, this means 50 writing type elements or writing type. If for each area of inscription, letters were also to be admitted, then for each area of inscription, this would represent an additional 25 symbols (alphabet). In consequence, it follows that only a few areas of inscription can be utilized by the known check writing device as otherwise the time required for writing the check and the structural complication would no longer be justifiable and in particular the pocket size of the check writing device would be far exceeded. With regard to the remaining structure, in the case of the known device, a relative movement has to take place between the writing types and the check surface in order to position the writing types in the writing position.

Further pocket-sized check writing devices are known from U.S. Pat. Nos. 1,456,388, 1,574,830 and 1,737,136. These devices, too, have substantially the same disadvantages as the previously described check writing machine.

In addition to the disadvantages mentioned, all the above-mentioned check writing machines have the advantage that the letters and figures written or printed with them are clearly and unequivocally legible, particularly by machine.

It is known from the U.S. Pat. No. 3,922,965 to use a mosaic writing head in which the symbol elements are individually controllable and are so disposed in relation to one another that they can be combined groupwise into predetermined writing symbols. However, this is not a pocket-sized check writing device. In detail, the check writing device known from U.S. Pat. No. 3,922,965 has a 5×7 matrix writing head, of which individual writing pins can be operated via solenoids. In this case, only a single writing head is provided which is passed mechanically, i.e., moved back and forth along the check lines which are to be written, by means of a specially guided chain transmission, In this case, one line is written in the normal direction of writing, while the next line in succession is written in the reverse writing direction. Switching pins provided in the chain give signals to recognize the line which is to be written. During the reciprocating movement of the writing head, the solenoids are program controlled by a data processing circuit disposed separably from the writing device. With the known device, it is possible indeed to write all the essential check data. It is however impossible to reduce it to a pocket size, just one reason being the mechanical chain drive for the writing head. What is more, it can logically only be operated with a data processing circuit, since in the case of manual operation of the device for selecting the writing type—along the lines of the keyboard of the check writing device according to the invention—considerable difficulties would occur when filling in a check line in the reverse direction from the usual writing direction.

From Germany Utility Model No. 1,978,415 there is indeed known an optical symbol inscribing head designed to produce on light sensitive materials alphanumerical symbols consisting of bar-like individual elements which can be switched on according to the symbol which is to be depicted. In particular, Germany Utility Model No. 1,978,415 has disclosed a so-called 16-segment writing head. However, this specification only mentions a single writing symbol head, but not the problem of constructing a pocket-sized writing device, let alone a pocket-sized check writing device. It is true that from the magazine "Der Elecktroniker" 1973, No. 2, pages 22 and 23, an optical projection system is known in which liquid crystals are employed. This citation has nothing further in common with the teaching according to the invention.

DOS (German Offenlegungsschrift) No. 2,018,834 discloses a method of and an apparatus for the electrographic printing of paper, the writing head being built up from individually controllable electrodes. The device known from this specification is however a relatively large device which is not subject to the particular problem which are posed in the case of a pocket writing device which is intended to be hand operated.

SUMMARY OF THE INVENTION

Accordingly, one object of this invention is to provide a novel check writing device of the type mentioned at the outset that while substantially retaining the advantages of known check writing devices, the operation thereof is made simpler and the number of required symbol elements and writing type elements can be considerably reduced.

This problem is resolved in that according to the invention each writing type is constructed as a mosaic writing head, the symbol elements being independent of one another and individually controllable and being so disposed in relation to one another that they can be assembled in groups for the predetermined writing symbols, and in that for each check writing location, one mosaic writing head is immovably disposed, and in that the arrangement has a keyboard which reproduces the writing symbols and in that a control unit is provided which associates the individual mosaic writing heads one after another with the set of keys (keyboard).

The fixed location of one mosaic writing head at each check writing area has the advantage that mechanical movement of writing heads back and forth and corresponding structural complication are no longer required. The means of positioning the check form in the writing position provides in this respect for the check form always to be correctly orientated in relation to the mosaic writing heads so that the check form is always written on in the correct places. The construction of the writing type as a mosaic writing head makes it possible, per area of writing, for all symbols to be inscribed by a single compact writing head. The control unit which associates the set of keys successively with the individual mosaic writing heads makes it possible, with a single set of keys, to operate or control all the writing heads one after another in the correct sequence. In this respect, the control unit may be constructed for example as a calculating mechanism or the like. Furthermore, the control unit may comprise a switching device which permits random transfer from one check line to the next check line.

Where check forms are concerned, it is usual to write out the amount of the check both in figures and also in letters or words. There is a clear connection between these two types of information. On the basis of this knowledge—with correspondingly rigidly disposed writing heads—according to a preferred embodiment, those writing heads which are provided for writing out the check sum in figures are so coupled with the writing heads for writing out the check amount in letters that by actuation of the digit writing heads, the letter writing heads are automatically operated. Instead of the automatic selection of the letter writing heads, it is also possible to provide an automatic selection of the digit writing heads. As a result, the filling-in of checks is substantially simplified.

The symbol elements provided in the mosaic writing head are preferably electrically operable in the check writing device according to the invention. If suitable component elements are used, it is possible in consequence to achieve a considerable saving on space. Preferably a dry battery is used as the source of the electrical energy.

For inscribing a check form with figures, the symbol elements are preferably located in a 7-segment pattern and form jointly a 7-segment writing head. The 7-segment pattern has more or less the form of an 8 composed of two squares. If it is desired that the writing heads be used for writing all the numbers or letters, then the symbol elements are preferably disposed in a 16-segment pattern and jointly form a 16-segment writing head. According to another development for a writing head for writing all the symbols which are to be written, the symbol elements are preferably pin or punch-like in construction and are disposed in a matrix fashion to produce a dot matrix writing head.

According to a particularly preferred embodiment of the check writing device according to the invention, the symbol elements of the mosaic writing head are constructed as light emitting elements. This development of the symbol elements makes it possible to inscribe check forms which have a photosensitive coating at least at the areas which are to be inscribed. This measure offers the advantage that for writing corresponding check forms, no mechanical movement of the symbol elements is required and a particularly simple construction of the device is possible. Constructing the symbol elements as liquid crystals guarantees a relatively high light yield per unit of energy employed. Liquid crystals furthermore have the advantage that they can be conveniently adapted to the spectral sensitivity of a photosensitive check form. The symbol elements can however also be built up from relatively intense light emitting diodes.

The invention also relates to a check form, particularly for use in the check writing device according to the invention, in which the symbol elements are constructed as light emitting elements. According to the invention, the check form has a photosensitive coating, at least at the areas which are to be inscribed, preferably after the fashion of an instant picture film (Polaroid film). Preferably, a plurality of check forms are constructed as an instant picture packfilm. This development has the advantage that a plurality of check forms can be stored in the device and in that each written out check is, after development, substantially secure against falsification. To this must be added the fact that the negative of the Polaroid film can be used as evidence of the check issued.

If instant picture film check forms are used in the check writing device according to the invention, it is advantageous for the means of positioning the check form in the inscription position to be constructed as an instant picture film cassette, preferably as an instant picture packfilm cassette.

Instead of an instant picture film, the photosensitive coating may also consist of a film having a light hardening component, particularly one which is cross-linked by photopolymerization. Such a coating may consist of a mixture of a soluble macromolecular carrier material, a multi-functional vinyl compound such as methylene bisacrylamide or xylylene bisacrylamide and a photoinitiator such as benzoin methyl ether or 2-t-butyl anthraquinone. Furthermore, the following monomers are known to be light cross-linking substances: acrylamide, methacrylamide, acrylonitrile, acrylic acid methyl ester, vinyl chloride, vinyl acetate, methacrylic acid-n-butyl ester, methacrylic acid-t-butyl ester, methacrylic acid-n-propyl ester, methacrylic acid methyl ester, vinylidene chloride, ethylene, styrene.

In the case of a further preferred example of embodiment of the invention, the symbol elements in the writing head are constructed as writing electrodes whereby preferably the means of positioning the check form in the writing position has an electrode disposed opposite the writing electrodes. This development of the check writing device makes it possible to use check forms which are built up from electrographically printable paper, at least at the areas which are to be inscribed.

The invention accordingly also comprises an electrographically inscribable check form. Such a check form has, at least at the areas which are to be inscribed, a coating in which for specific pH value conversions, a color reaction takes place which is limited to the conversion area and which has a stable end product. By applying electrical charges to the writing electrodes, the charges in opposition thereto in the paper are subtracted. In consequence, a pH value conversion is brought about and a color reaction is set in motion.

In the case of a further preferred form of embodiment of the invention, there is connected in parallel with the writing heads a display part which is likewise adapted to be actuated by the set of keys, for reproducing the particular group of symbol elements (writing symbols) which have been actuated. This display part serves to reproduce the particular symbols which have been selected and thus provide the means of monitoring them.

In conjunction with this, the set of keys preferably also has erase buttons and the device for actuating the writing type has a memory unit, the address inputs of which are located at the keys of the set of keys and of which the outputs are located at the display part and the writing heads. The printing out of the memory contents or the selection of the corresponding writing heads can be controlled in this case by a separate key.

The display part is in this case constructed as an alphanumerical illuminated display.

Preferably, this display part is constructed as a lid and is so articulatingly connected to the rest of the check writing device that when it is in the closed state, it covers the set of keys. Such a lid has the advantage that when the check writing device is being carried in the pocket, the keys are protected from being operated in error.

A considerable facility for the user of the check writing device is achieved in that the arrangement for selecting the writing heads has an electronic calculator mechanism which actuates the writing heads and which can be operated by the set of keys. The calculator mechanism is hereby preferably connectable to the rest of the check writing device by means of a plug-in connection. If the arrangement for selecting the writing heads has the aforementioned memory unit, then the electronic calculating mechanism is preferably connected between the keys and the memory. The calculating mechanism has the great advantage that before any issuing of checks with the device according to the invention, conversions between different currencies, examination of accounts, calculations of interest and interest on interest, etc., can be carried out conveniently.

Furthermore, it is advantageous to provide the means of operating the writing heads with a date generator which automatically actuates the writing heads provided for the date and thus permits of automatic writing of the date of issue.

In the case of a check writing device with a date generator and linkage of the writing heads provided for the check amount which is to be written out in figures with the writing heads provided for writing out the amount of the check in words, it is likely that the user will only be required to key in the amount of the check in figures and the relevant place of issue.

The check writing device according to the invention facilitates the issuing of checks, particularly for persons with a haptic impairment, since key operation is as a rule simpler than writing by hand.

As a safeguard against unauthorized use of the check writing device according to the invention, this latter preferably has a slot into which it is possible to insert a check card which has a check card number stamped into it. The check writing device can be used only after the check card number has been recognized as correct. In addition to or in place of this feature, the check writing machine may also be provided with the identity card and/or passport number of the check card holder. The identity card and/or passport number is preferably stamped into the housing of the device. In addition, a passport picture of the check card holder may also be located on the device in such a way as to be safeguarded against forgery.

BRIEF DESCRIPTION OF THE DRAWINGS

A more complete appreciation of the invention and many of the attendant advantages thereof will be readily obtained as the same becomes better understood by reference to the following detailed description when considered in conjunction with the accompanying drawings, wherein.

DESCRIPTION OF THE PREFERRED EMBODIMENTS

Figure 1:
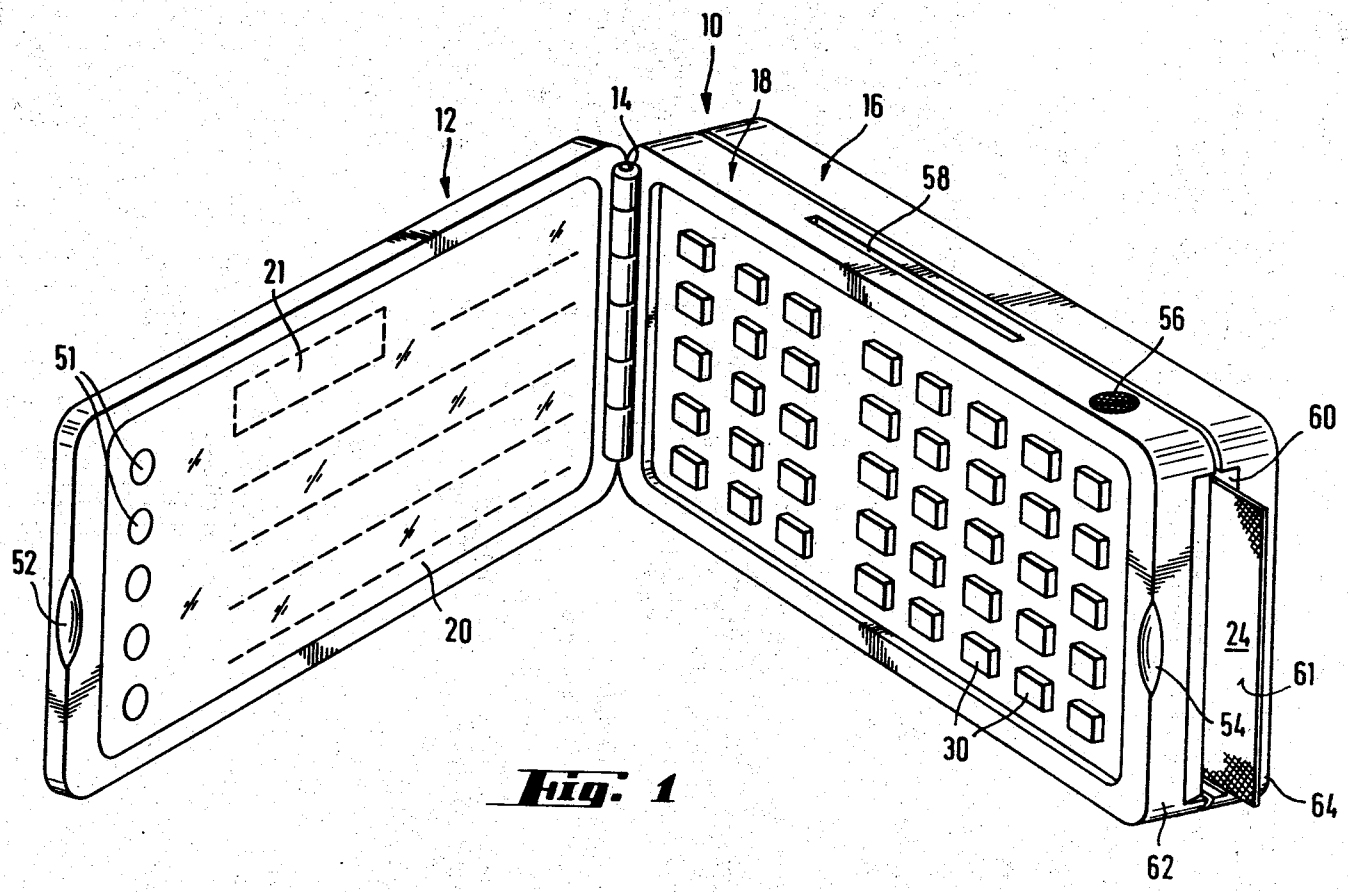
FIG. 1 shows a first example of embodiment in the operative position.
Figure 3:
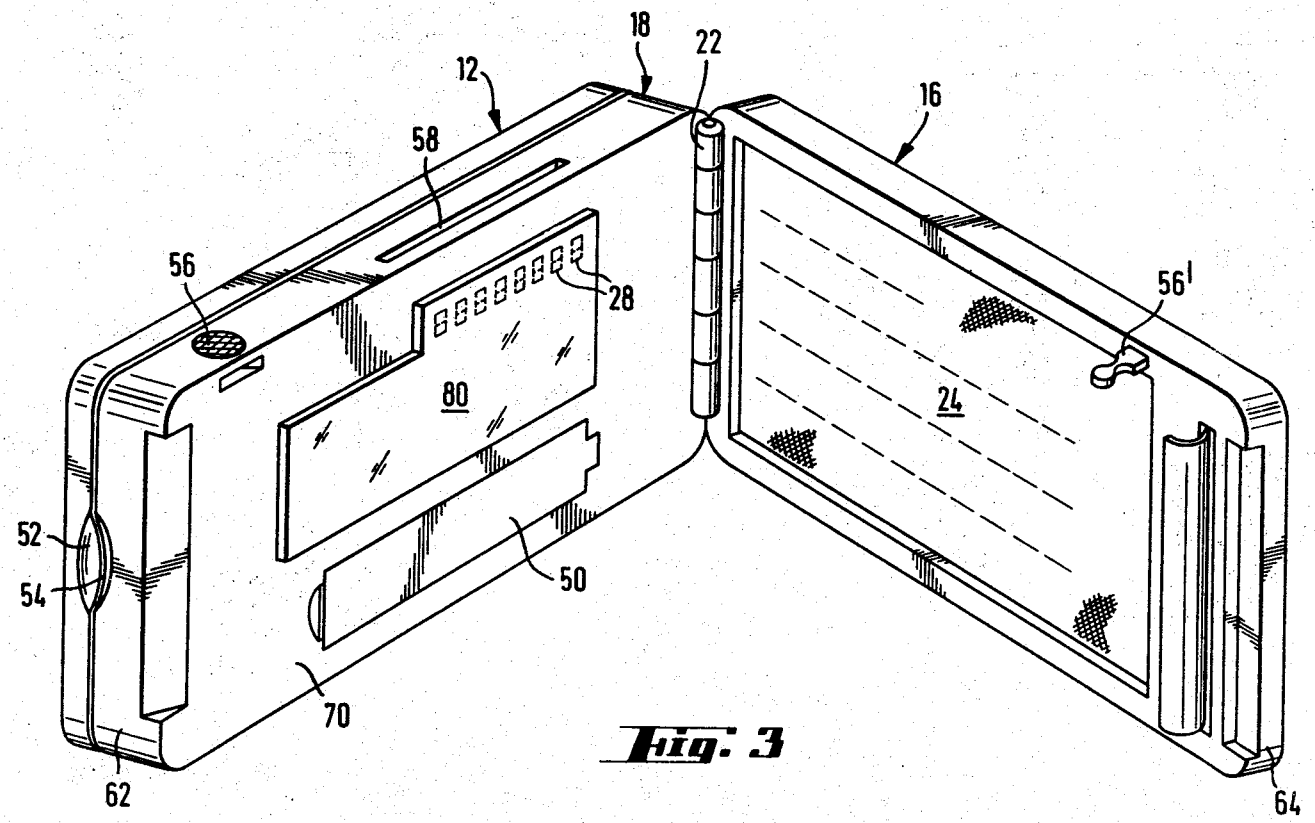
FIG. 3 shows the example of embodiment illustrated in FIG. 1 but with the bottom unit opened.
Figure 7:
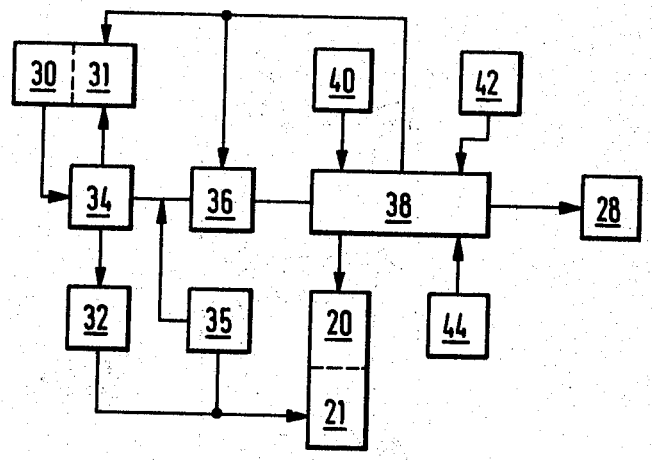
FIG. 7 is a block circuit diagram of the device according to the invention.

Referring now to the drawings, wherein like reference numerals designate identical or corresponding parts throughout the several views, and more particularly to FIG. 1 thereof, the example of the embodiment shown in FIGS. 1, 3 and 7 has a base part.

Figure 4:
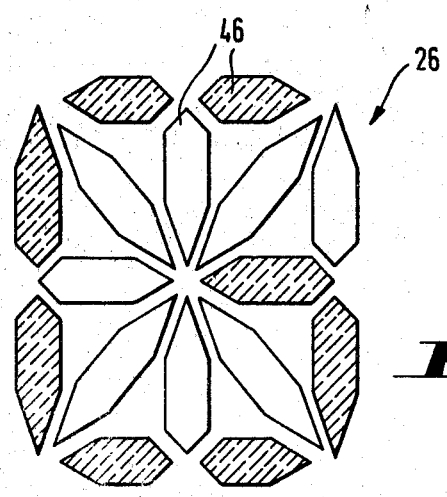
FIGS. 4 and 5 show two examples of embodiment of writing type.
Figure 5:
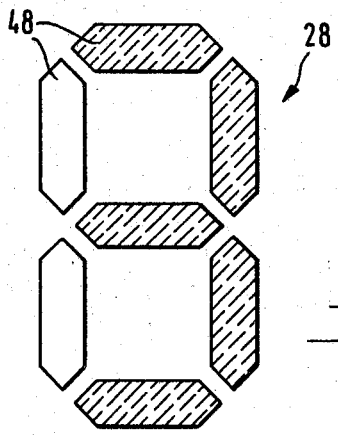

The example of embodiment shown in FIGS. 1, 3 and 7 has a base part 10 and a display part 12. The display part 12 has a display panel 20, is constructed as a lid and is articulated to the base part 10 via a hinge 14. According to FIG. 3, the base part 10 is hinged to open and comprises a bottom unit 16 and a control unit 18. The two units 16, 18 and articulated to each other by a hinge 22. The two hinges 14 and 22 are disposed parallel with each other. The bottom unit 16 serves as a magazine for photosensitive check forms 24. For this purpose, the bottom unit 16 according to the first example of embodiment is constructed as a holder designed to receive an instant picture cassette. The photosensitive form 24 is adapted to be inscribed by the writing type 27 and 28 illustrated in FIGS. 4 and 5, the writing elements 46 and 48 of which are constructed as light emitting elements, by using the principles known in the production of instant pictures. In order to select the writing type, a set of keys 30 is provided. As a source of energy for the device according to the invention, a dry battery is used which is disposed in the control unit 18 and which is accessible via a cover 50.

According to FIGS. 1 and 7, the control unit 18 is equipped with an electronic calculating mechanism 32 which constitutes the CPU portion of a microprocessor. The electronic calculating mechanism 32 can be connected to the set of keys 30 via the button or the selector switch 34. The keys 30 are extremely flat snap-action contacts. In order to display the data fed into the calculating mechanism 32 or the intermediate results calculated by the calculating mechanism 32, there is provided in the display part 12 a calculator display zone 21 which is operated directly by the calculating mechanism 32. The calculator display zone 21 is equipped with 7-display elements which, for energy conservation reasons, are built up from liquid crystals. The four basic calculation operations, namely addition, subtraction, multipliation and division, can be carried out by the calculating mechanism 32. Furthermore, keys are provided for address and input of desired values into buffer stores. Via an interface 35, the output of the calculating mechanism 32 can be controllably connected to the control input for the writing types 23 by means of the below described coupling element 36 and the memory 38.

By means of the set of keys 30, the desired data—via the calculating mechanism 32—are fed into a memory 38. After actuation by a trigger unit 42, the memory 38 actuates the writing type 28. When this happens, the set of keys 30 are serially associated with in each case a memory unit and each memory unit is associated exactly with a writing type 28. Switch-over of the set of keys 30 to whichever is the next memory unit is brought about by a control and coupling element function of the PROM 36. The control and coupling element 36 also fulfills a further function, namely the simultaneous selection of a plurality of memory units. In this respect, this is based on the consideration that the check sum shown on the check is usually reproduced in figures and in words. However, there is a clear relationship between these figures and words or letters. By feeding in the check sum in figures, therefore, it is established which letters have to be written into those memory position which corresponds to the check amount when expressed in letters. Accordingly, it is sufficient to feed in one of the two sets of information by means of the set of keys 30. The other set of information can then automatically be written into the memory 38. This purpose is served by the control and coupling element 36 which is fed back to the memory 38.

Since in the case of a check it is furthermore established at which area of inscription it is always necessary to locate figures or letters respectively, there is a reversal element 31 which is controlled by the memory 38. By virtue of this reversal element 31, for example the first ten keys may be constructed as dual function keys whereby, according to the switched condition of the reversal element 31, a number or a letter is written into the corresponding memory unit.

The inscription condition of the memory 38 is reproduced by the display model 20 of the display part 12. Expediently, for this purpose, the display panel 20 is subdivided in the same way as a check form. Accordingly, it has corresponding lines for the currency, the check sum which is to be expressed in figures and letters, the payee, the place of issue and the date. In order to show clearly which line is being written on at the time, there are in each case at the edge of the line ligbht emitting diodes 50 which emit an illuminated signal when the corresponding line is being inscribed.

In conjunction with the display panel 20, the memory 38 serves the purpose of obviating any "miswriting" of the check form 24. For this reason, a trigger unit 42 is provided which only passes the memory contents to the writing type 28 when a corresponding control signal to the trigger unit 42 is present. For correction purposes, furthermore, an erase module 40 is provided with which erroneously written memory units can be erased and rewritten.

The functionally described blocks 31–32, 34–36, 38, 40 and 42, although shown as separate blocks in the FIG. 7 for purposes of clarity in the operation are, in practice, a microprocessor such as the series CDP of "National Semiconductor" or TMS1000 of "Texas Instruments". The normally associated function represented by the blocks of FIG. 7 include the CPU, RAM, ROM, PROM and/or EPROM. Further expansion of the system is possible by using external memories to provide additional identification of a person having a check card.

A further safeguard against miswriting and thus a simplification of the operation of the check writing device according to the invention is provided by a date generator 44 which automatically writes the correct date into the memory 38 and can also directly select the appropriate writing type 28.

The feedback between the selector switch 34 and the reversal element 31 serves the purpose, when the calculating mechanism 32 is actuated, of only passing on to the calculating mechanism 32 the numerical information of the dual function keys.

The example of embodiment illustrated in FIG. 1 is switched to the operating condition by opening up the display part 12, via a switch provided for the purpose. For easier opening of the display part 12, there are on the latter and on the control unit 18, two recesses 52 and 54 which form a trough. The bottom unit 16 can be locked on the control unit 18 by a locking device 56, 56'.

Figure 1A:
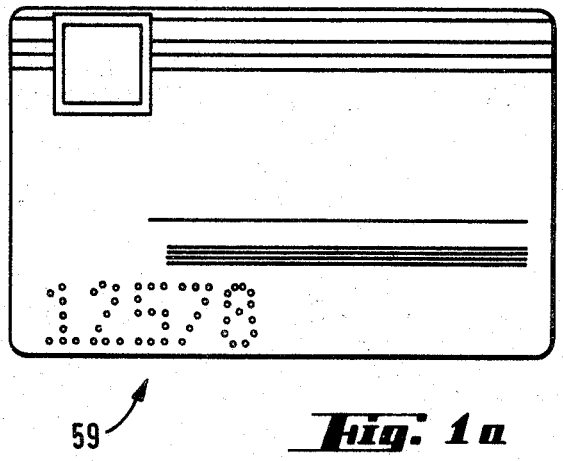
FIG. 1*a* shows a check card which can be pushed into the device.

In order substantially to exclude the possibility of unauthorized use of the check writing device according to the invention, there is furthermore provided in the control unit 18 a check card slot 58 through which the check card 59 shown in FIG. 1*a* can be pushed. A corresponding reading module checks the pushed in check card 59 and, if there are no faults, allows the device to be operated. According to the check card 59 which is shown in FIG. 1*a*, the check card number is stamped into the check card 59.

For issuing of the inscribed photosensitive check form 24, there is provided at the connecting seam between the bottom unit 16 and the control unit 18 and in the region of the end portions 64 and 62, a delivery slot 60.

According to FIG. 3, a window 80 is let into the bottom wall 70 of the control unit 18. Immediately behind the window 80, the writing types 26 are disposed in one plane and irradiate through the window onto the photosensitive check form 24. The disposition of the writing types 26 is so chosen that for each area to be inscribed on the check form 24, there is exactly one writing type 26. To insure greater clarity, only one line of writing types 26 is shown in FIG. 3. By corresponding selection, the writing types 26 or the memory 38 are serially connected to the set of keys 30. The writing types 26 are all according to the 16-segment writing type 26 shown in FIG. 4 composed of individual writing elements 46. The writing elements 46 consist of liquid crystal units. At those writing areas which are only to be inscribed with figures, in other words the areas provided for the check amount which is to appear in figures and the date, it is possible instead also to use the 7-segment writing type 28 shown in FIG. 5. Also the inscription elements 48 thereof are built up from liquid crystals.

For the issuing of a check, the initially inscribed negative is withdrawn from the device together with the positive in the manner already known in the production of instant pictures.

In the case of the example of embodiment illustrated, the check form magazine takes the form of an instant picture packfilm magazine and is fitted into the bottom unit 16. The bottom unit 16 is hereby so constructed that the instant picture magazine is easily interchangeable. Facing the window 80 is a stack of for example ten sheets of light sensitive negative material. The negatives are kept flat by the window 80 and a plate provided under the negatives, for example after the manner of a pressure applying plate 90 shown in FIG. 6. In front of each negative is a narrow bag containing jelly-like chemicals which are required for developing the picture. Behind the flat plate or pressure-applying plate is a stack of ten light-insensitive positive check forms. Guide strips consisting of paper connect each negative and the positive associated with it to a first strip. This latter in turn is connected to a narrow second strip 61 which peeps out from the issuing slot 60. After exposure of the negative, the second strip 61 is pulled completely out of the issuing slot 60. This brings about two things:

The first strip pushes itself through corresponding spreaders in the developing mechanism so that it peeps out of the issuing slot 60 and the exposed negative is drawn behind the pressure-applying or flat plate so that it is opposite the positive which is associated with it. In order to develop the picture, the first strip is pulled completely out of the issuing slot 60. When this happens, negative and positive are pulled through between the spreaders of the developing mechanism. As a result of the pressure of the spreaders, the capsule bursts in front of the negative and the jelly-like developing paste is evenly distributed between negative and positive. When this happens, development of the check commences and takes place outside of the check writing device. Negative and positive have a light-impermeable backing, and the jelly is a safeguard against incident light from the edges. After development, the positive is substantially protected from any falsification. This constitutes a substantial advantage over known check writing devices. In addition, the negative can be used as evidence of the check issued.

Figure 2:
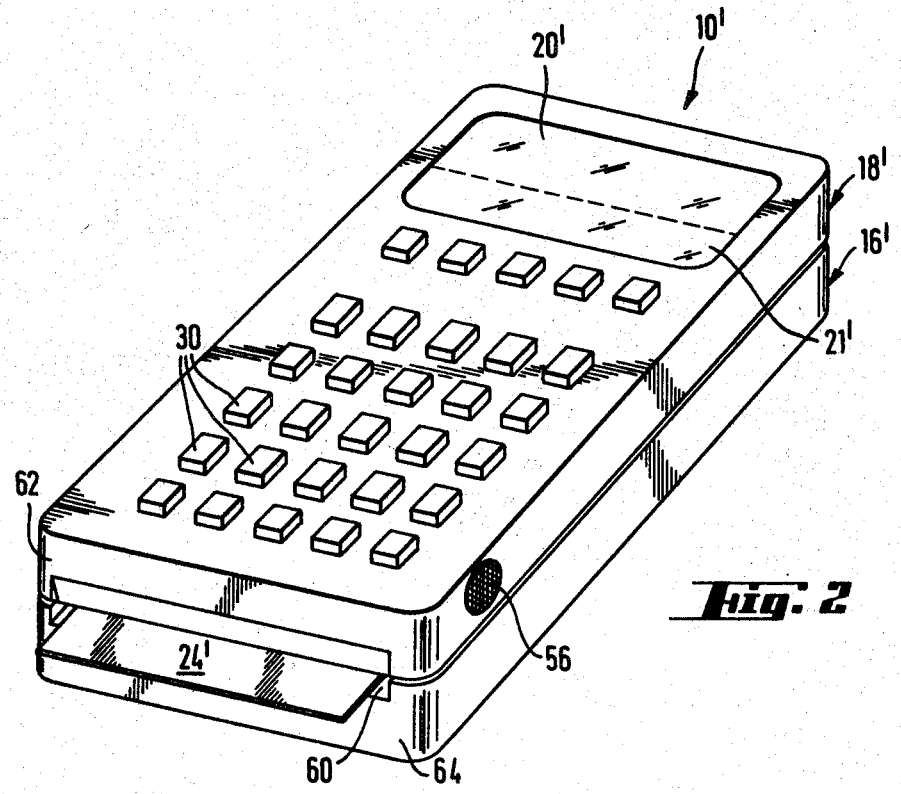
FIG. 2 shows a further example of embodiment.
Figure 6:
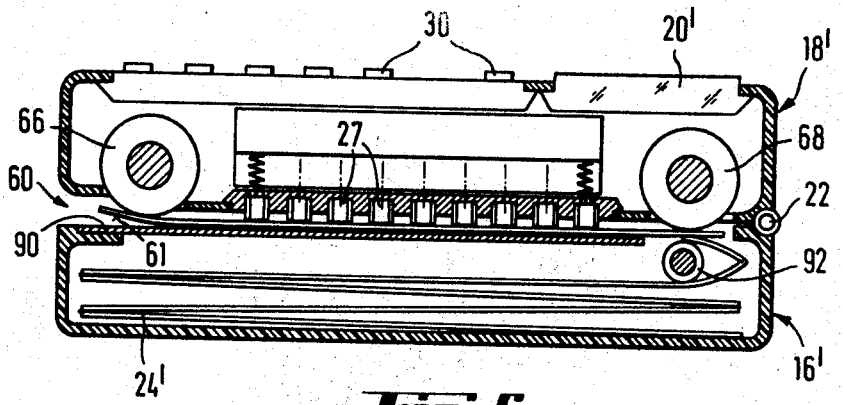
FIG. 6 shows a cross-section through the example of embodiment illustrated in FIG. 2.

The example of embodiment shown in FIGS. 2 and 6 is intended for an electrochemical writing of check forms 24'. Its circuitry corresponds substantially to the example of embodiment shown in FIG. 7. According to FIG. 2, the check writing device consists essentially of the base part 10' which in turn comprises the bottom unit 16' and the control unit 18'. In this example, too, the bottom unit 16' is articulatingly connected to the control unit 18' in such a way that the control unit 18' can be opened up according to the embodiment shown in FIG. 3. Furthermore, a display panel 20' and a calculator display panel 21' as well as a set of keys 30 for the actuation of writing type 27 are provided.

The inscribing elements for the writing type 27 are hereby of pin-like construction and are disposed in the manner of a matrix. Opposite the writing type 27 and in the bottom part 16' is a pressure-applying plate 90 having conductive zones, the size of which corresponds to the writing type area. The check forms 24' in the case of this example of embodiment consist of a paper which is impregnated with a liquid consisting essentially of the following components:

1. diazotizable primary aromatic amine,
2. alkline metallic nitrile as a nitrous acid dispenser,
3. neutral electrolyte for conduction in the paper, and
4. coupling element which may form a dyestuff with the diazobenzene.

If, now, the writing type 27 is selected according to the symbols which it is desired to inscribe, then there is a shift or variation in charge in the check form 24', since this latter is located immediately between the writing type 27 and the pressure-applying plate 90. This variation in charge results in a variation in the pH value at the locations on the check form 24' which are immediately beneath the writing type 27. As a result, in per se known manner, a color reaction is initiated to produce a stable end product. The stable end product then constitutes the symbol printed on the check form 24'.

With this example of embodiment, too, the bottom part 16' is constructed to hold an exchangeable packfilm cassette. To avoid damage to the check forms 24', a reversing roller 92 is provided in front of the free end of the pressure-applying plate 90. Feed rollers 66 and 68 which lock briefly as soon as a new check form has been brought completely into the position of inscription on the conductor plate 90, serve for easier check withdrawal and positionally correct location of the check forms 24'.

On a basis of present-day technology, the check writing device according to the invention can be made so compact that it corresponds more or less to the size of a wallet.

Obviously, numerous modifications and variations of the present invention are possible light of the above teachings. It is therefore to be understood that within the scope of the appended claims, the invention may be practiced otherwise than as specifically described herein.

What is claimed as new and desired to be secured by Letters Patent of the United States is:

1. In a pocket-sized cheque writing device having a means for positioning a cheque form in a writing position, a plurality of non-impact mosaic writing heads for reproducing alpha-numeric symbols positioned with respect to said writing position and a manually operable alpha-numeric keyboard for actuating each of said writing heads individually by means of a control unit, the improvement comprising:

each of said plurality of writing heads being the size of a single character, being independently controllable and addressable, and being immovably disposed within said device to register with one of a plurality of predetermined cheque writing locations of said cheque form with a one to one relationship being established between each of said writing heads and each of said check writing locations; and said control unit being mechanically arranged and electrically connected between said keyboard and said plurality of writing heads in order to successively provide an association of said keyboard with each one of said plurality of writing heads.

2. The improved writing device according to claim 1 wherein at least one of said plurality of writing heads is provided for indicating the digits of a cheque sum and wherein at least one other one of said mosaic writing heads is provided for indicating the cheque amount in alphabet form whereby said at least one of said writing heads which provided for said digits is connected with said at least one other one of said mosaic heads provided for writing said cheque amount in alphabet form so that when said digit writing heads are actuated the corresponding ones of said cheque amount writing heads are automatically actuated.

3. The improved device according to claims 1 or 2 wherein said symbol elements are assembled into a 16-segment writing head.

4. The improved device according to claims 1 or 2 wherein said symbol elements are assembled into a 7-segment writing head.

5. The improved device according to claims 1 or 2 herein said symbol elements are assembled into a dot matrix writing head.

6. The improved device according to claims 1 or 2 wherein said symbol elements are light emitting elements.

7. The improved device according to claim 6 wherein said check form is of the instant picture film type which is further comprises a means for positioning the check in the writing position and is constructed as an instant picture cassette.

8. The improved device according to claims 1 or 2 wherein said check form is an electrographically inscribable check form having said symbol elements constructed as writing electrodes and having a positioning means for positioning the check form in the writing position such that an electrode is disposed opposite said writing electrodes.

9. The improved device according to claims 1 or 2 further having a display means connected in parallel with said writing heads to be actuated by said set of keys in order to reproduce on said display means a selected group of said symbol elements which have been actuated at a particular time.

10. The improved device according to claim 9 wherein said display means is constructed as a hinged lid.

11. The improved device according to claims 1 or 2 wherein an electronic calculator mechanism is controlled by said keys for actuating said writing heads.

12. The improved device according to claims 1 or 2 which further includes a date generator means for actuating said writing heads.

* * * * *